United States Patent [19]

Henderson, Jr. et al.

[11] 4,173,037

[45] Oct. 30, 1979

[54] LAMP SUPPORT DEVICE

[75] Inventors: Alfred J. Henderson, Jr., Chagrin Falls, Ohio; Thomas A. Fletcher, Dana, N.C.

[73] Assignee: General Electric Company, Schenectady, N.Y.

[21] Appl. No.: 846,735

[22] Filed: Oct. 31, 1977

[51] Int. Cl.[2] ..... F21V 19/02

[52] U.S. Cl. ..... 362/287; 362/269; 362/270; 362/275; 362/277; 362/285; 362/368; 362/369; 362/372; 362/390; 362/418; 362/419; 362/427; 362/428; 362/429; 362/431

[58] Field of Search ..... 362/390, 285, 289, 269, 362/270, 275, 277, 418, 419, 422, 424, 427, 428, 429, 431, 369, 372, 287, 368

[56] References Cited

U.S. PATENT DOCUMENTS

| | | | |
|---|---|---|---|
| 960,998 | 6/1910 | Neple | 362/429 |
| 1,282,594 | 10/1918 | Kossmann | 362/427 |
| 1,825,641 | 9/1931 | Wolarsky | 362/429 |
| 1,882,185 | 10/1932 | Graham | 362/427 |
| 2,141,879 | 12/1938 | Russell | 362/429 |
| 2,826,679 | 3/1958 | Irmischer et al. | 362/269 |
| 3,694,649 | 9/1972 | Thompson | 362/390 |
| 3,882,306 | 5/1975 | Armstrong | 362/427 |

FOREIGN PATENT DOCUMENTS

| | | | |
|---|---|---|---|
| 544972 | 8/1957 | Canada | 362/269 |
| 518118 | 2/1931 | Fed. Rep. of Germany | 362/418 |
| 478381 | 10/1969 | Switzerland | 362/418 |

*Primary Examiner*—Benjamin R. Padgett
*Assistant Examiner*—T. S. Gron
*Attorney, Agent, or Firm*—Sidney Greenberg

[57] ABSTRACT

Luminaire lamp support device for vertical and angular adjustment of vertically-mounted lamp. The device includes a pair of spaced L-shaped plates secured at their bottom to the luminaire reflector in which the lamp is positioned and secured at their upwardly extending legs to an inverted U-shaped hinge bracket to which the lamp socket is secured. The hinge bracket is adjustably secured to the L-shaped plates for pivoting thereon about a horizontal axis. The socket is adjustably mounted on another U-shaped bracket secured to the hinge bracket for adjustment of the socket along a substantially vertical axis.

10 Claims, 6 Drawing Figures

LAMP SUPPORT DEVICE

The present invention relates to luminaires and particularly to lamp supports for luminaires.

It is an object of the invention to provide an improved lamp support device for luminaires for enabling adjustment of the lamp to different positions to obtain various light distribution patterns.

It is a particular object of the invention to provide a lamp support device of the above type for readily adjusting a vertically mounted lamp, especially of gaseous discharge type, along a substantially vertical axis and about a horizontal axis.

Still another object of the invention is to provide a lamp support device of the above type which provides protection of the lamp against vibration and securely supports the lamp in various adjusted positions.

A further object of the invention is to provide a lamp support device of the above type which is simple and compact in structure and occupies a minimal volume of space in the luminaire.

Other objects and advantages will become apparent from the following description and the appended claims.

With the above objects in view, the present invention in one of its aspects relates to a lamp support device comprising, in combination, a pair of spaced elongated support members defining a first axis adapted to be secured within a luminaire, a U-shaped hinge bracket having opposite legs defining a second axis and respectively adjustably secured to the spaced elongated support members in overlapping relation thereto for adjustment of the U-shaped hinge bracket to selected positions along the second axis and at angles to the first axis, elongated socket support means secured to the U-shaped hinge bracket for movement therewith and extending along the second axis, and socket means adjustably secured to the elongated socket support means for adjustment relative thereto to selected positions along the second axis.

The invention will be better understood from the following description taken in conjunction with the accompanying drawings, in which.

Figure 1:
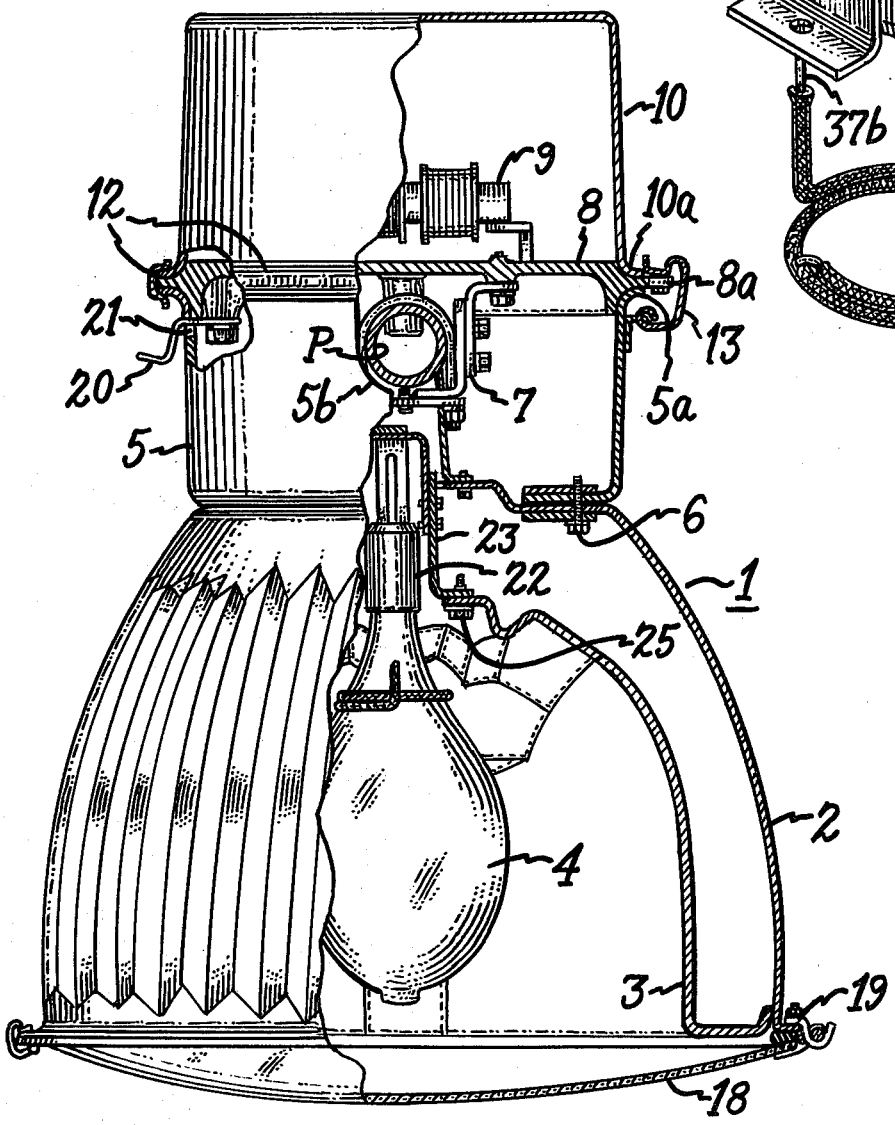
FIG. 1 is an elevational view, with parts broken away, of a luminaire embodying the invention.

Referring now to the drawings, and particularly to FIG. 1, there is shown a luminaire of a type in which the lamp support device of the invention may be embodied comprising an optical assembly 1 including dome-shaped housing or reflector 2 and lamp 4 which is typically a high intensity gaseous discharge lamp. An inner reflector 3 shown enclosed within housing 2 has a configuration for producing asymmetric distribution of reflected light, and is mounted in housing 2 for rotational adjustment about the vertical axis of the luminaire. The open bottom of housing 2 is closed by light transmitting closure 18 which is secured to the rim of housing 2 by clamp band 19 or other suitable means.

Secured at the top of optical assembly 1 by bolts 6 or the like (see FIG. 1) is slipfitter housing 5 which is cylindrical in shape and has an open top defined by an outwardly flaring rim 5*a*. A U-shaped cutout 5*b* is provided in slipfitter housing 5 to allow passage of support pipe P on which the luminaire is mounted by means of adjustable slipfitter or pipe clamp 7.

Arranged covering the open top of slipfitter housing 5 is a circular disc-like mounting plate 8 seated on rim 5*a* with a correspondingly shaped lower mating surface on its periphery. Slipfitter 7 is secured to the underside of mounting plate 8, so as to be positioned within slipfitter housing 5.

Mounted on the upper side of mounting plate 8 are electrical operating components such as ballast transformer 9 for operating discharge lamp 4. Arranged on top of mounting plate 8 and enclosing the electrical components thereon is ballast housing 10 which is similar in shape to slipfitter housing 5 with a closed top and open bottom and has a flaring rim 10*a* at its bottom seated on the upper peripheral mating surface of mounting plate 8.

Embracing the annular joint thus formed by rims 5*a*, 10*a*, and the intervening periphery of mounting plate 8 and locking the parts in assembly is clamp band fastener 12 which is formed of two sections respectively hinged on lug 8*a* projecting from mounting plate 8 and latched together at their free ends (not shown). At the hinged side of clamp band 12 is arranged spring clamp 13 of generally U-shaped hingedly secured to slipfitter housing 5 and resiliently bearing on the upper side of lug 8*a*.

Figure 2:
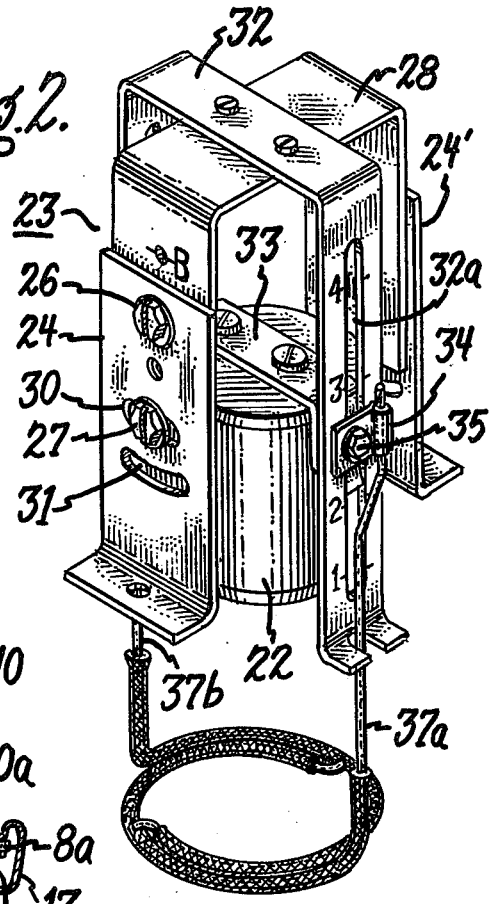
FIG. 2 is a perspective view in enlarged scale of the lamp support device shown in the FIG. 1 luminaire.
Figure 3:
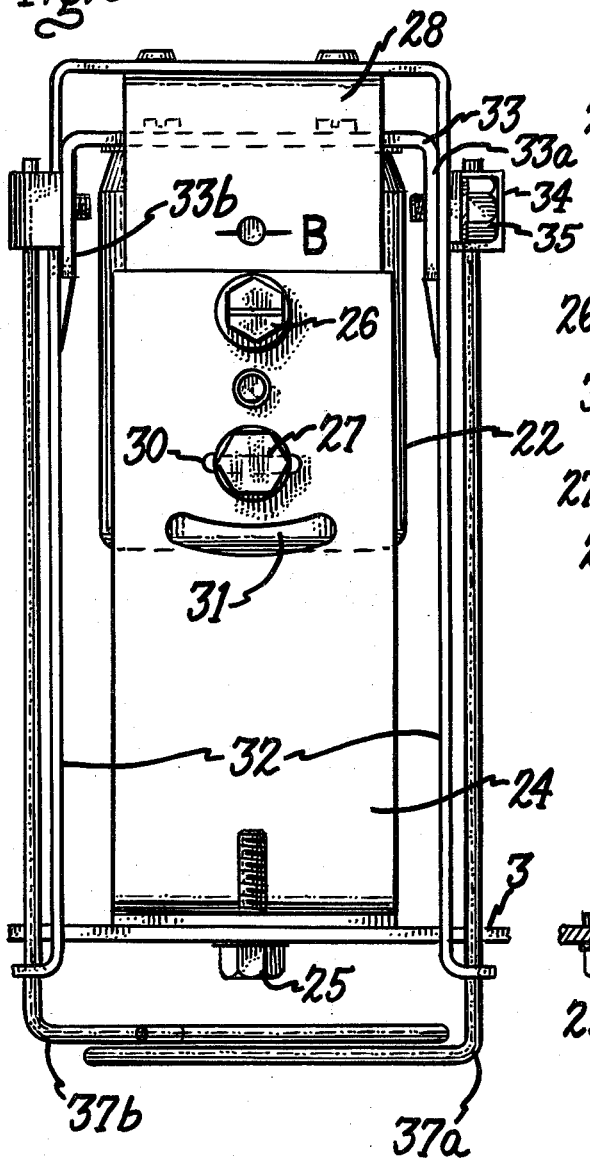
FIG. 3 is a side elevational view of the lamp support device.
Figure 4:
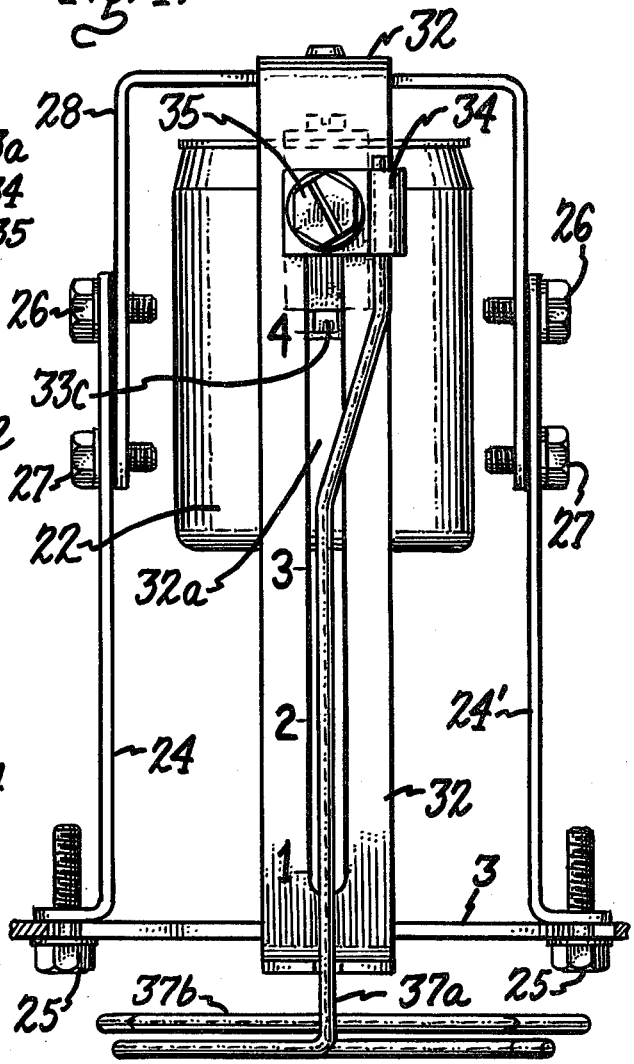
FIG. 4 is a front elevational view of the lamp support device.
Figure 5:
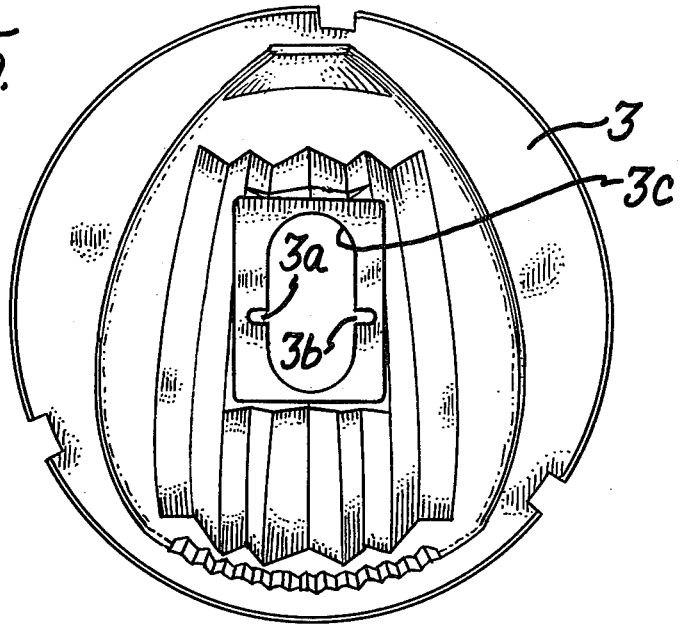
FIG. 5 is a top plan view of the asymmetrical reflector shown in the FIG. 1 luminaire.

In accordance with the present invention, a lamp support and positioning device 23 is constructed and arranged in the luminaire to support lamp 4, which is removably mounted in base-up position in socket 22, and to provide for adjustment of lamp socket 22 to different vertical positions in the luminaire, and also at different angles to the vertical axis of the luminaire. As seen in FIG. 2, lamp positioning device 23 comprises a pair of spaced L-shaped plate members 24, 24' defining a first longitudinal axis and secured at their lower legs to the top of reflector 3 by means of screws 25 (see FIGS. 1 and 4) which are inserted in slots 3*a*, 3*b* at opposite sides of elongated opening 3*c* formed in the top of reflector 3 (see FIG. 5). The upstanding legs of plate members 24, 24' are each secured by screws 26, 27 respectively to the legs of U-shaped hinge bracket 28, which define a second longitudinal axis, and each of which is formed with vertically spaced holes, designated A and B (see FIG. 6), into which screws 26 may be selectively inserted to vertically adjust the position of hinge bracket 28 relative to plate members 24, 24'. The latter members are also provided with a plurality of vertically spaced holes, as seen in FIG. 3, into which screw 26 may selectively be inserted for similar adjustment of the relative positions of hinge bracket 28 and plate members 24, 24'. Screw 27 passes freely through upper slot 30 in the respective plate members 24, 24' and when screws 26 and 27 are loosened, hinge bracket 28 can pivot about screws 26 as screws 27 move within slots 30 which serve to limit the angle through which hinge bracket 28 can swing. To enable hinge bracket 28 to swing through a longer arc, screw 27 is inserted in longer slot 31 formed in plate members 24, 24' below slot 30.

As seen in FIG. 2, lamp socket 22 is adjustably mounted by means of inverted U-shaped support bracket 32 secured to hinge bracket 28 with its web at right angles to the web of hinge bracket 28. The strip-shaped legs of support bracket 32, which extend downwardly on opposite sides of the socket axis, are each formed with an elongated slot 32*a* extending a substantial distance along its length. Connected to support bracket 32 and bridging the space therebetween is socket bracket 33 to which socket 22 is fastened at its upper (closed) end. At opposite ends, socket bracket 33 is formed (see FIG. 3) with flanges 33*a*, 33*b*, from each of which a narrow tongue 33*c* (see FIG. 4) projects and is bent so as to enter slot 32*a* of the legs of support bracket 32 along which it is slidable.

Clamp 34, which is arranged with a flat portion overlying the outer surface of support bracket 32 (see FIG. 4) and a curved portion extending around the side edge of the bracket leg, is secured to the latter and to the adjacent flange 33*a* of socket bracket 33 by screw 35 which passes with a loose fit through slot 32*a* and is in threaded engagement with bracket flange 33*a*. As a result, when screw 35 is loosened, clamp 34 is movable along with socket bracket 33 for movement of attached socket 22 and lamp 4 to any desired axial position permitted by the limits of slot 32*a*. Pre-selected positions of clamp 34 are indicated by indicia 36 provided on the surface of support bracket 32.

Figure 6:
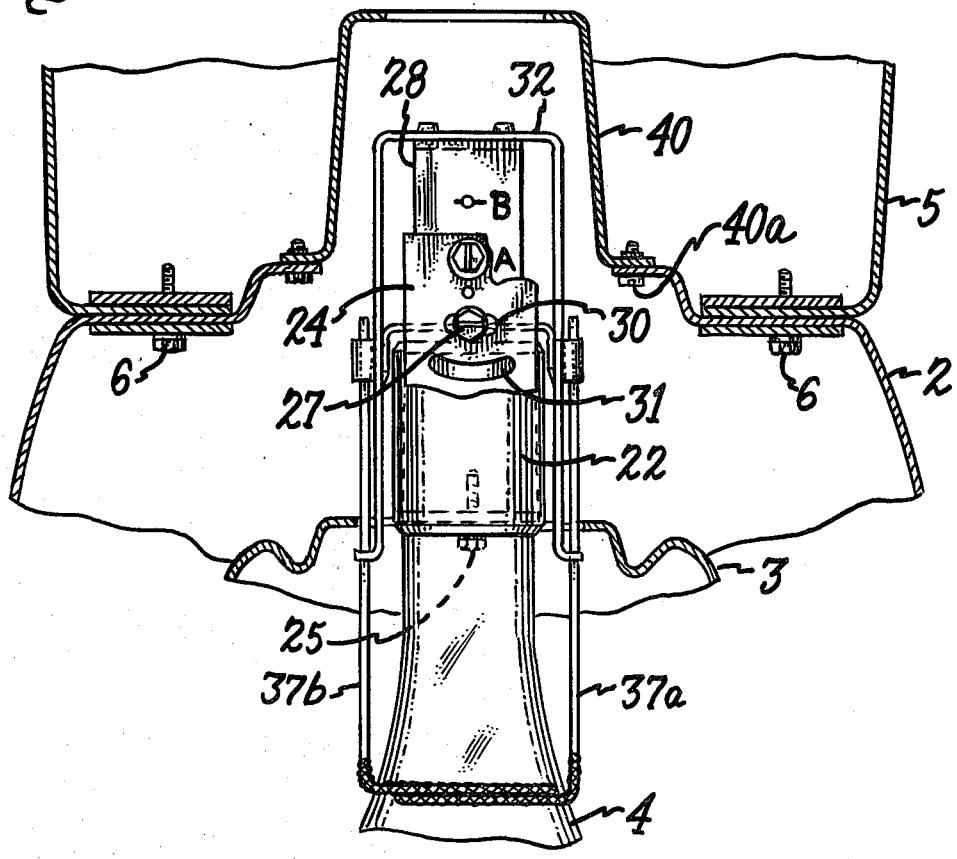
FIG. 6 is a fragmentary view of the luminaire interior showing the lamp support device mounted therein.

Lamp retaining means in the form of stiff spring-like wire members 37*a*, 37*b* are connected at one end to clamps 34 on opposite sides of support bracket 32 and extend downwardly therefrom with their opposite looped ends arranged below socket 22 for engaging lamp 4, as seen in FIG. 6. Further details of the structure and function of the lamp retaining means are disclosed in U.S. Pat. No. 3,694,649 issued Sept. 26, 1972, and assigned to the same assignee as the present invention, and the disclosure thereof is accordingly incorporated herein by reference.

As seen best in FIG. 6, the upper end of the lamp support and positioning device extends upwardly into slipfitter housing 5 and is covered by protective housing 40 secured at its bottom flange 40*a* to housing 2 as shown. Because of the limitations imposed by protective housing 40 on the swinging movement of hinge bracket 28 when the latter is in its upper positions and the risk of damage to lamp 4 by impact on reflector 3, pivot screw 27 is inserted in shorter slot 30 to limit the swing of hinge bracket 28. When the latter is in its lower positions, where the above-mentioned problems are not encountered, screw 27 may be inserted into longer slot 31 to allow a greater arc of swing for the hinge bracket.

By virtue of the disclosed lamp support device, the light center of the lamp may be moved horizontally relative to the reflector to change the distribution of the light to different industry standard types of roadway lighting, and the light center may be moved vertically to change the angle of maximum candle power in vertical planes (cone angle).

An advantage in mounting the lamp in vertical position as shown is that certain gaseous discharge lamps operate most efficiently in that position, and some gaseous discharge lamps exhibit longer life and better maintenance of their light output level when operated in this manner. Additional benefits resulting from the described luminaire arrangement are the relatively small volume of space above reflector 3 occupied by the motion of lamp socket 22, and the need for only a relatively small cut-out area in the top of reflector 3.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

What we claim as new and desire to secure by Letters Patent of the United States is:

1. A lamp support device comprising, in combination, a pair of spaced elongated support members defining a first axis and adapted to be secured within a luminaire, a U-shaped hinge bracket having opposite legs defining a second axis and respectively adjustably secured to said spaced elongated support members in overlapping relation thereto for adjustment of said U-shaped hinge bracket to selected positions relative to said support members along said second axis and at angles to said first axis, elongated socket support means secured to said U-shaped hinge bracket for movement therewith and extending along said second axis, and socket means adjustably secured to said elongated socket support means for adjustment relative thereto to selected positions along said second axis.

2. A device as defined in claim 1, said pair of support members and said legs of said hinge bracket having a plurality of apertures adapted to be selectively aligned with each other for positioning said hinge bracket in predetermined positions along said second axis, and fastening means inserted in the aligned apertures for holding said hinge bracket in said predetermined positions.

3. A device as defined in claim 2, said support members each having slot means extending transverse said first axis, and adjustable second fastening means inserted into said slot means and engaging said hinge bracket for movement of the latter bracket about said first mentioned fastening means to predetermined angular positions relative to said support members and for holding said hinge bracket in said predetermined angular positions.

4. A device as defined in claim 3, said slot means comprising a plurality of slots of different length spaced along said first axis.

5. A device as defined in claim 1, including means adjustably secured to said elongated socket support means for engaging a lamp mounted in said socket means for holding the lamp against vibration.

6. A luminaire comprising, in combination, housing means having an open bottom, a concave reflector in said housing means facing said open bottom, and having a top portion formed with an opening, and a lamp support device extending through said opening for mounting a lamp in said concave reflector, said lamp support device comprising a pair of spaced elongated support members defining a first axis and secured to said reflector top portion at said opening, a U-shaped hinge bracket having opposite legs defining a second axis and respectively adjustably secured to said spaced elongated support members in overlapping relation thereto for adjustment of said U-shaped hinge bracket to selected positions relative to said support members along said second axis and at angles to said first axis, elongated socket support means secured to said U-shaped hinge bracket for movement therewith and extending along said second axis, and socket means adjustably secured to said elongated socket support means for adjustment relative thereto to selected positions along said second axis.

7. A luminaire as defined in claim 6, said pair of support members and said legs of said hinge bracket having a plurality of apertures adapted to be selectively aligned with each other for positioning said hinge bracket in predetermined positions along said second axis, and fastening means inserted in the aligned apertures for holding said hinge bracket in said predetermined positions.

8. A luminaire as defined in claim 7, said support members each having slot means extending transverse said first axis, and adjustable second fastening means inserted into said slot means and engaging said hinge bracket for movement of the latter bracket about said first mentioned fastening means to predetermined angular positions relative to said support members and for holding said hinge bracket in said predetermined angular positions.

9. A luminaire as defined in claim 8, said slot means comprising a plurality of slots of different length spaced along said first axis.

10. A luminaire as defined in claim 9, including means adjustably secured to said elongated socket support means for engaging a lamp mounted in said socket means for holding the lamp against vibration.

* * * * *